US010225665B2

(12) United States Patent
Green

(10) Patent No.: US 10,225,665 B2
(45) Date of Patent: Mar. 5, 2019

(54) HEARING AID SYSTEM

(71) Applicant: Mason Green, Savage, MN (US)

(72) Inventor: Mason Green, Savage, MN (US)

( * ) Notice: Subject to any disclaimer, the term of this patent is extended or adjusted under 35 U.S.C. 154(b) by 0 days.

(21) Appl. No.: 15/629,742

(22) Filed: Jun. 22, 2017

(65) Prior Publication Data

US 2018/0376256 A1 Dec. 27, 2018

(51) Int. Cl.
*H04R 25/00* (2006.01)

(52) U.S. Cl.
CPC ..... *H04R 25/43* (2013.01); *H04R 25/502* (2013.01); *H04R 25/505* (2013.01); *H04R 25/554* (2013.01); *H04R 25/558* (2013.01); *H04R 25/75* (2013.01); *H04R 25/55* (2013.01); *H04R 2225/61* (2013.01)

(58) Field of Classification Search
CPC ..... H04R 25/43; H04R 25/505; H04R 25/55; H04R 25/554; H04R 25/558; H04R 25/75; H04R 2225/43; H04R 2225/55; H04R 2225/61; H04R 25/502
See application file for complete search history.

(56) References Cited

U.S. PATENT DOCUMENTS 3,475,566 A * 10/1969 Bauer ..... H01H 19/62 381/322
4,222,393 A * 9/1980 Hocks ..... A61B 5/12 600/559
5,167,236 A * 12/1992 Junker ..... A61B 5/12 600/559
5,341,433 A * 8/1994 Meyer ..... H04R 25/502 381/324
D397,796 S 9/1998 Yabe et al.
6,041,128 A * 3/2000 Narisawa ..... H04R 25/602 381/322
7,590,254 B2 9/2009 Olsen
8,374,366 B2 2/2013 Kidmose
9,002,045 B2 4/2015 Merks
2004/0234089 A1 11/2004 Rembrand et al.
2006/0185969 A1* 8/2006 Erbe ..... H01H 1/5805 200/14
2008/0064993 A1* 3/2008 Abolfathi ..... A61M 21/00 601/47
2010/0054510 A1* 3/2010 Schumaier ..... H04R 25/70 381/314
2011/0013793 A1* 1/2011 Klemenz ..... H04R 25/50 381/321
2011/0051967 A1* 3/2011 Lim ..... H04R 25/60 381/322
2011/0235834 A1* 9/2011 Brimhall ..... H04R 25/65 381/314

(Continued)

*Primary Examiner* — Joshua Kaufman

(57) ABSTRACT

A hearing aid system includes an electronic device that may be manipulated. A hearing aid is provided and the hearing aid is selectively worn in an ear thereby facilitating the hearing aid to amplify ambient sounds. A noise generator is coupled to the hearing aid and the noise generator is in electrical communication with the electronic device. The electronic device controls operational parameters of the noise generator and the noise generator selectively emits white noise. The noise generator is in electrical communication with the hearing aid such that the hearing aid emits the white noise in conjunction with the ambient sounds. In this way the noise generator enhances a sensitivity threshold of the ear.

9 Claims, 4 Drawing Sheets

(56) References Cited

U.S. PATENT DOCUMENTS

| | | | |
|---|---|---|---|
| 2015/0181357 | A1 | 6/2015 | Krystek et al. |
| 2015/0256942 | A1 | 9/2015 | Kinsbergen et al. |
| 2015/0310847 | A1 | 10/2015 | Dave et al. |
| 2015/0319541 | A1 | 11/2015 | Burger |

* cited by examiner

HEARING AID SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to hearing devices and more particularly pertains to a new hearing device for enhancing a sensitivity threshold of a human ear.

BRIEF SUMMARY OF THE INVENTION

An embodiment of the disclosure meets the needs presented above by generally comprising an electronic device that may be manipulated. A hearing aid is provided and the hearing aid is selectively worn in an ear thereby facilitating the hearing aid to amplify ambient sounds. A noise generator is coupled to the hearing aid and the noise generator is in electrical communication with the electronic device. The electronic device controls operational parameters of the noise generator and the noise generator selectively emits white noise. The noise generator is in electrical communication with the hearing aid such that the hearing aid emits the white noise in conjunction with the ambient sounds. In this way the noise generator enhances a sensitivity threshold of the ear.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
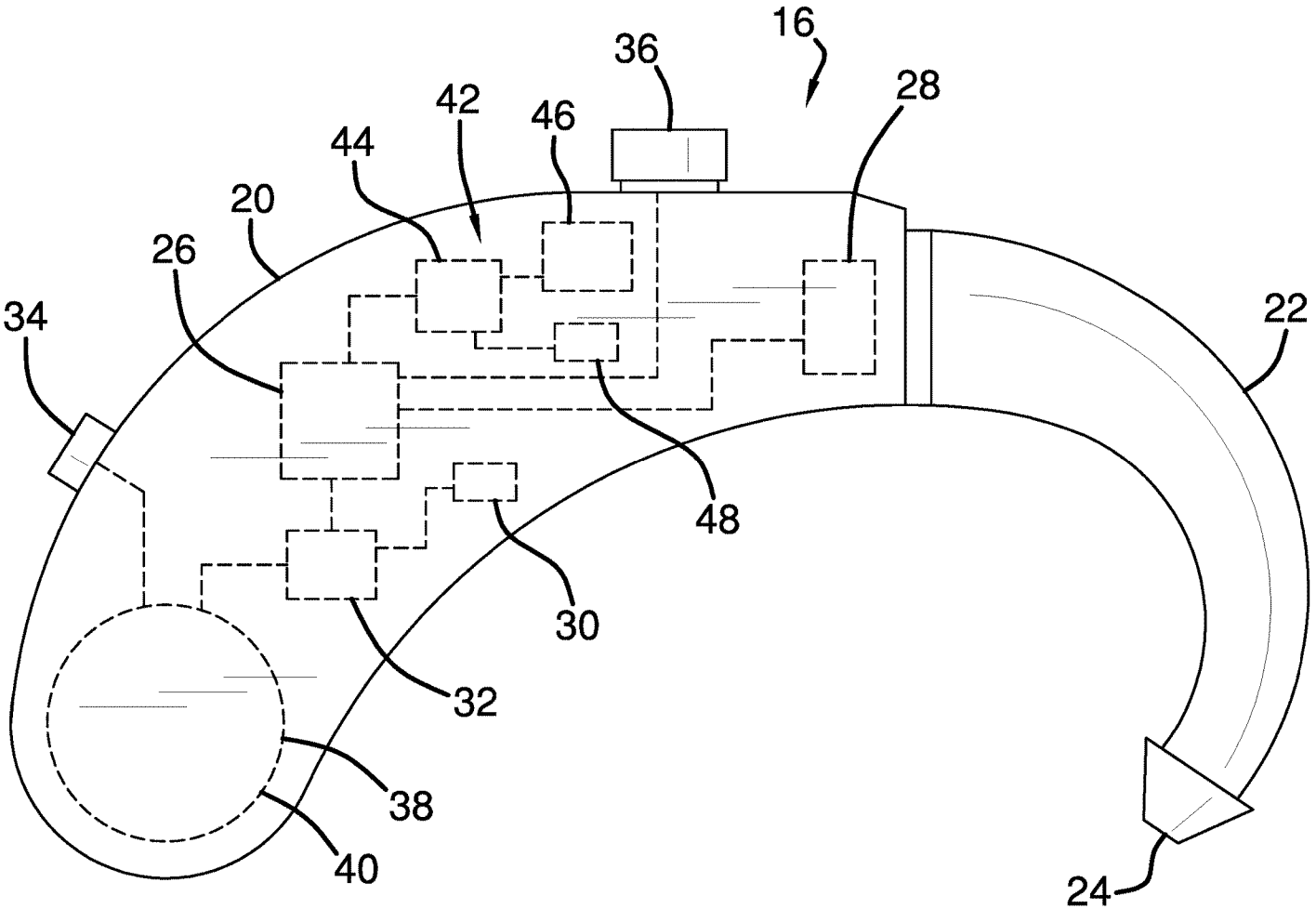
FIG. 1 is a phantom view of a hearing aid system according to an embodiment of the disclosure.
Figure 2:
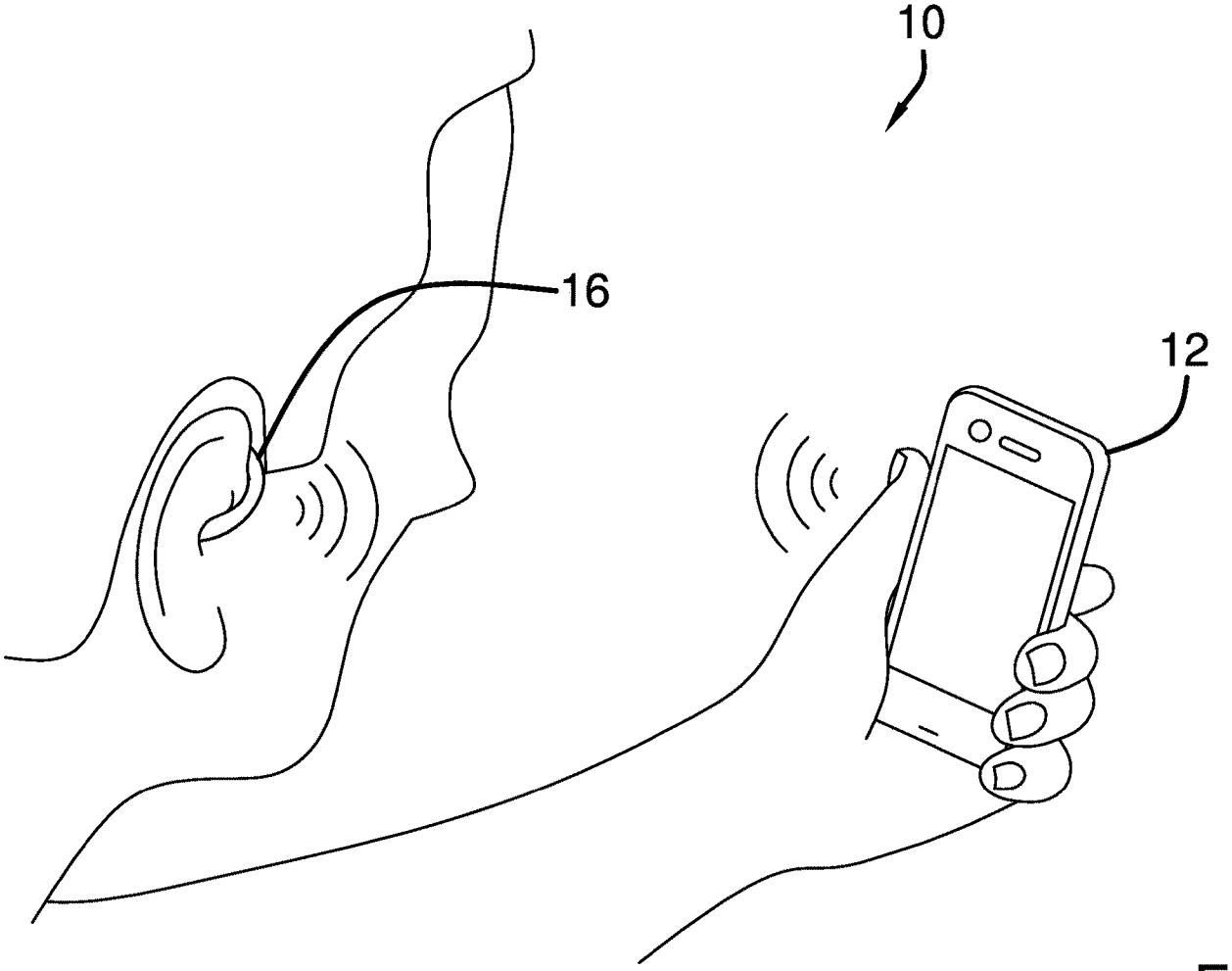
FIG. 2 is a perspective in-use view of an embodiment of the disclosure.
Figure 3:
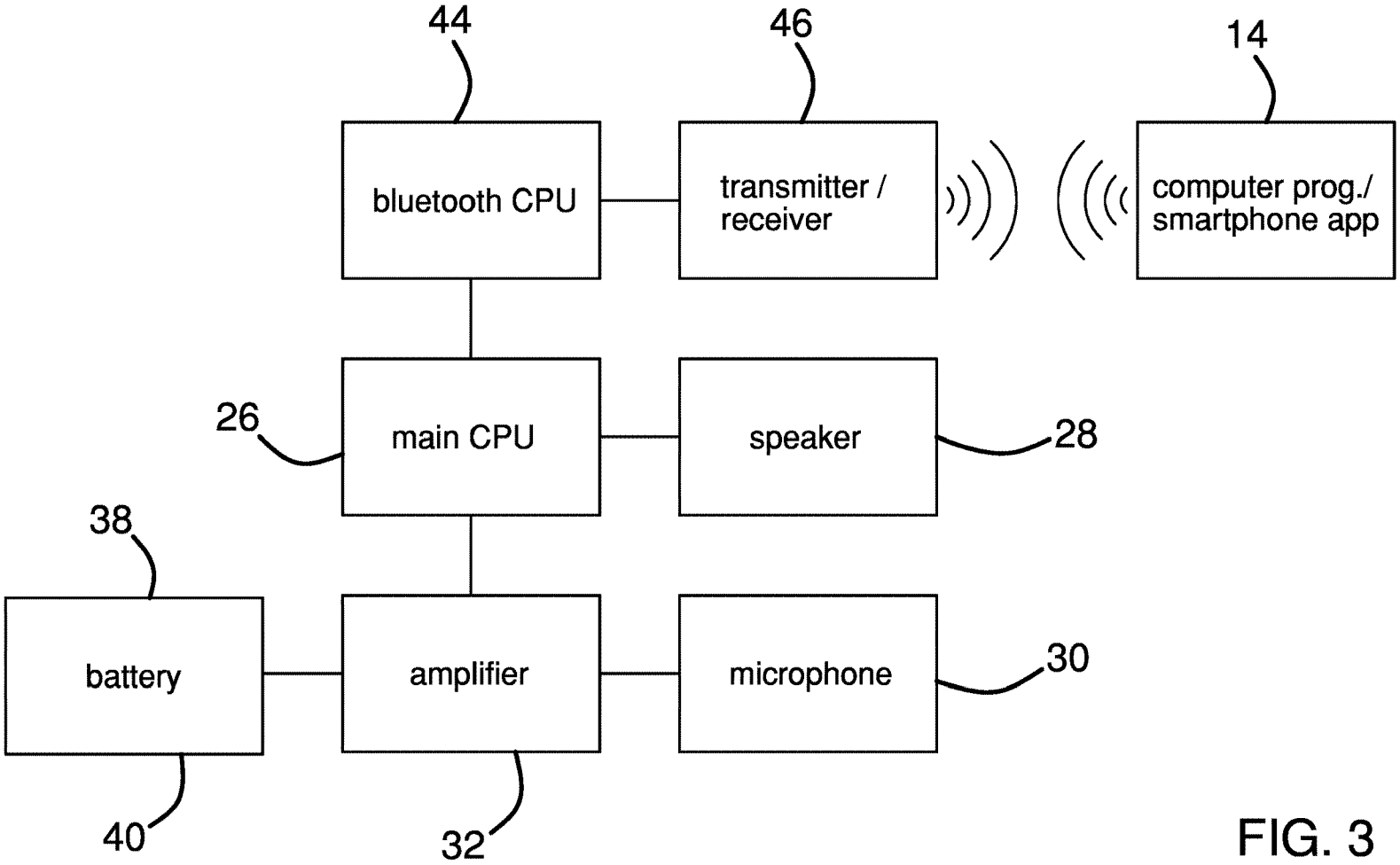
FIG. 3 is a schematic view of an embodiment of the disclosure.

With reference now to the drawings, and in particular to FIGS. 1 through 4 thereof, a new hearing device embodying the principles and concepts of an embodiment of the disclosure and generally designated by the reference numeral 10 will be described.

As best illustrated in FIGS. 1 through 4, the hearing aid system 10 generally comprises an electronic device 12 that is selectively manipulated. The electronic device 12 has a first transceiver 14 and the electronic device 12 may be a smartphone, an I-pad or any other type of electronic device 12 that employs a WPAN signal and Bluetooth communication protocols. A hearing aid 16 is provided and the hearing aid 16 is worn in an ear 18 thereby facilitating the hearing aid 16 to amplify ambient sounds. The hearing aid 16 comprises a housing 20 that is positioned on the ear 18 and a tube 22 that is coupled to the housing 20. The tube 22 has a distal end 24 with respect to the housing 20 and the distal end 24 is positioned in the ear 18. The hearing aid 16 may be an electronic hearing aid 16 of any conventional design.

A first processor 26 is provided and the first processor 26 is positioned within the housing 20. A speaker 28 is positioned within the housing 20 and the speaker 28 emits audible sound. The speaker 28 is electrically coupled to the first processor 26 and the speaker 28 is in fluid communication with the tube 22. In this way the tube 22 directs the audible sound into the ear 18. The speaker 28 may be an electronic speaker 28 or the like that is common to the technology of hearing aids 16.

A microphone 30 is coupled to the housing 20 and the microphone 30 detects ambient sounds with respect to the housing 20. The microphone 30 is electrically coupled to the first processor 26 and the microphone 30 may comprise an electronic microphone 30 or the like that is common to the technology of hearing aids 16. An amplifier 32 is positioned within the housing 20 and the amplifier 32 is electrically coupled to the first processor 26. The amplifier 32 receives a signal from the microphone 30 and the amplifier 32 amplifies the signal such that the speaker 28 emits the amplified signal. In this way the ambient sounds are amplified to an intensity sufficient to permit a hearing impaired user to hear 18 the ambient sounds. The amplifier 32 may be an electronic amplifier 32 or the like that is common to the technology of hearing aids 16.

A button 34 is coupled to the housing 20 and the button 34 is selectively manipulated. The button 34 is electrically coupled to the first processor 26 to turn the first processor 26 on and off. A knob 36 is rotatably coupled to the housing 20 and the knob 36 is selectively manipulated. The knob 36 is electrically coupled to the amplifier 32 to adjusting an intensity of the amplifier 32 between a minimum intensity and a maximum intensity. In this way a volume of the speaker 28 is selectively adjustable. A power supply 38 is provided and the power supply 38 is positioned in the housing 20. The power supply 38 is electrically coupled to the first processor 26 and the power supply 38 comprises at least one battery 40.

A noise generator 42 is provided and the noise generator 42 is coupled to the hearing aid 16. The noise generator 42 is in electrical communication with the electronic device 12. Additionally, the electronic device 12 controls operational parameters of the noise generator 42. The electronic device 12 may store an app, a program or any other electronic means of controlling the noise generator 42.

Figure 4:
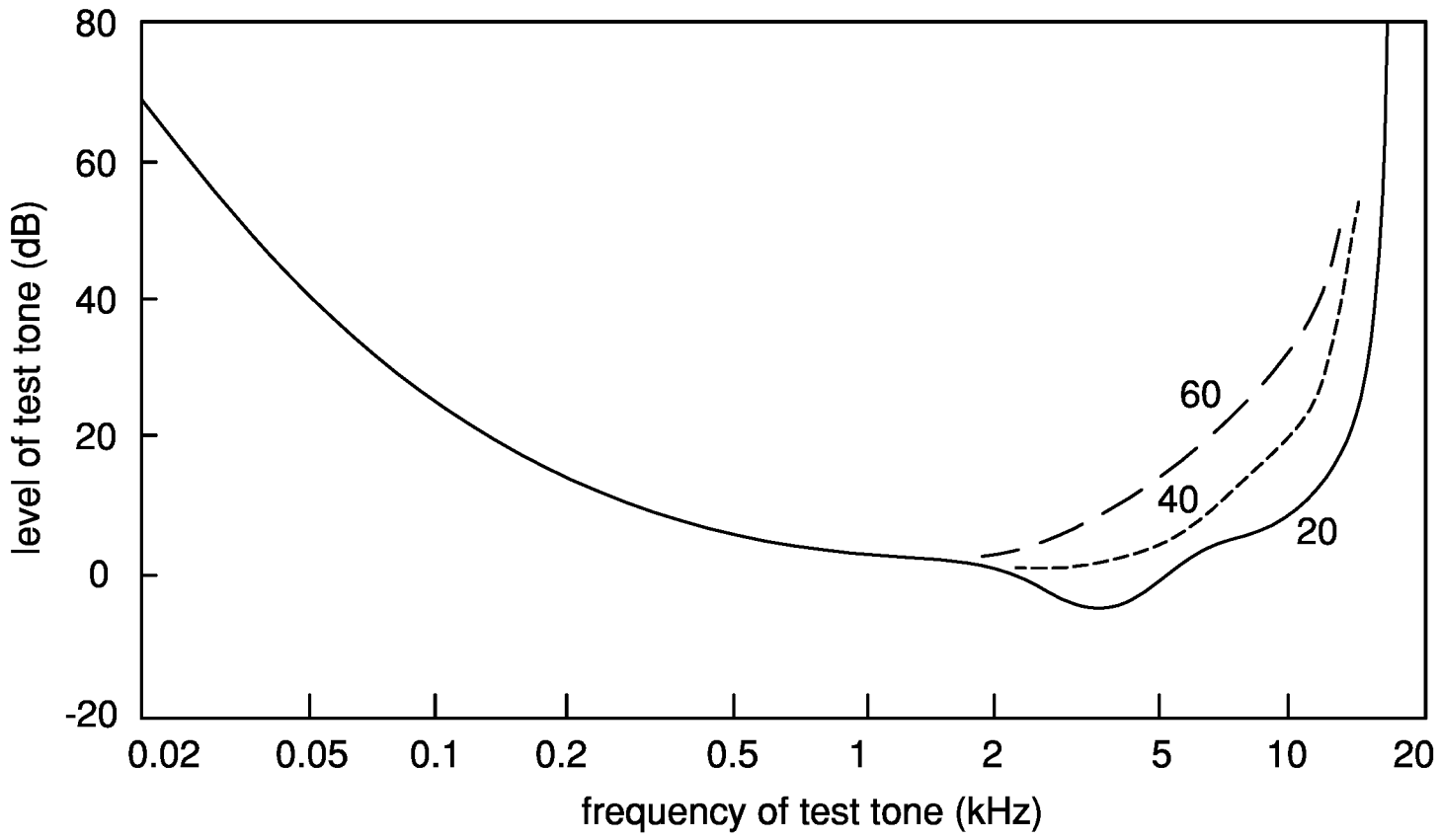
FIG. 4 is a graph view of an embodiment of the disclosure.

The noise generator 42 selectively emits white noise and the noise generator 42 is in electrical communication with the hearing aid 16. Moreover, the hearing aid 16 emits the white noise in conjunction with the ambient sounds. In this way the phenomenon of stochastic resonance with respect to a human ear 18 enhances a sensitivity threshold of the human ear 18. Additionally, the noise generator 42 may be a unitary structure with respect to the hearing aid 16 and the noise generator 42 may be an aftermarket add on. A graph as shown in FIG. 4 shows a potential result of the hearing test.

The noise generator 42 comprises a second processor 44 that may be positioned within the housing 20. The second processor 44 is electrically coupled to the first processor 26 and the second processor 44 may comprise an electronic processor or the like. A second transceiver 46 may be positioned within the housing 20 and the second transceiver 46 is electrically coupled to the second processor 44. The second transceiver 46 is in electrical communication with the first transceiver 14 and the second transceiver 46 may be a radio frequency transceiver or the like. Moreover, the second transceiver 46 may employ a WPAN signal and Bluetooth communication protocols.

A signal generator 48 is provided and the signal generator 48 may be positioned within the housing 20. The signal generator 48 is electrically coupled to the second processor 44 such that the electronic device 12 controls operational parameters of the signal generator 48 via the second transceiver 46. The signal generator 48 selectively generates the white noise at a selected intensity. The intensity of the white noise and the occurrence of the white noise are selected on the electronic device 12. Additionally, the speaker 28 emits the while noise along with the ambient sounds. In this way the phenomenon of stochastic resonance is harnessed to enhance the ear's 18 ability to hear sounds that would otherwise be above and below a detection threshold of a human ear.

The app and program on the electronic device 12 may comprise a hearing test program or the like. The speaker 28 may emit selected test tones and the electronic device 12 may record if and when the test tones are heard by the user. In this way the electronic device 12 generates a frequency curve to determine the appropriate intensity and occurrence of the white noise. The signal generator 48 generates the white noise at an intensity and occurrence that corresponds to results of the hearing test. In this way the phenomenon of stochastic resonance is harnessed and applied to facilitate the user to hear 18 sounds that would otherwise be too low and too high for the user to hear 18.

The second transceiver 46 may be selectively placed in electrical communication with an extrinsic microphone array or other sound detection system. The second transceiver 46 may feed sounds detected by the extrinsic microphone array to the speaker 28. In this way the user may be facilitated to hear 18 sounds captured at a distance from the user. The extrinsic microphone array may be employed by military personnel, police, private investigators or other individuals seeking to have discrete access to conversations and other sounds that would otherwise be too distant to hear.

In use, the hearing aid 16 is worn and the electronic device 12 is manipulated to generate the hearing test. The results of the hearing test are analyzed and the electronic device 12 actuates the signal generator 48 to generate the white noise at the selected intensity and occurrence corresponding to the hearing test. Thus, the phenomenon of stochastic resonance is harnessed to enhance the sensitivity threshold of the ear 18. Additionally, the hearing aid 16 functions in the traditional convention of hearing aids 16 regarding amplifying ambient sounds with respect to the user. In this way the hearing aid 16 serves dual functions by amplifying the ambient sounds and enhancing the sensitivity threshold of the ear 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hearing aid system selectively generating white noise wherein said system is configured to enhance a user's ability to hear otherwise inaudible sounds, said system comprising:

an electronic device being configured to be manipulated;

a hearing aid being configured to be worn in an ear thereby facilitating said hearing aid to amplify ambient sounds, said hearing aid comprising a housing being configured to be positioned on an ear, a tube being coupled to said housing, said tube having a distal end with respect to said housing wherein said distal end is configured to be positioned in the ear, a first processor being positioned within said housing, a microphone being coupled to said housing wherein said microphone is configured to detect ambient sounds, said microphone being electrically coupled to said first processor, an amplifier being positioned within said housing, said amplifier being electrically coupled to said first processor such that said amplifier receives a signal from said microphone, said amplifier amplifying said signal such that said speaker emits the amplified signal, and a knob being rotatably coupled to said housing wherein said knob is configured to be manipulated, said knob being electrically coupled to said amplifier, said knob adjusting an intensity of said amplifier being a minimum intensity and a maximum intensity, said knob being disposed substantially at a middle of said housing on an upwardly facing surface of said housing as said housing is worn, said knob being rotatable in a plane parallel to said upwardly facing surface, said knob having a smooth peripheral surface wherein said knob is configured to inhibit abrasion of the user when said housing is worn and while said knob is rotated; and a noise generator being coupled to said hearing aid, said noise generator being in electrical communication with said electronic device such that said electronic device controls operational parameters of said noise generator, said noise generator selectively emitting white noise, said noise generator being in electrical communication with said hearing aid such that said hearing aid emits the white noise in conjunction with that ambient sounds wherein said noise generator is configured to enhance a sensitivity threshold of the ear.

2. The assembly according to claim 1, further comprising a speaker being positioned within said housing wherein said speaker is configured to emit audible sound, said speaker being electrically coupled to said first processor, said speaker being in fluid communication with said tube wherein said tube directs the audible sound into the ear.

3. The assembly according to claim 1, further comprising a button being coupled to said housing wherein said button is configured to be manipulated, said button being electrically coupled to said first processor such that said button turns said first processor on and off.

4. The assembly according to claim 1, further comprising a power supply being positioned in said housing, said power supply being electrically coupled to said first processor, said power supply comprising at least one battery.

5. The assembly according to claim 1, wherein said noise generator comprises a second processor being positioned within said housing, said second processor being electrically coupled to said first processor.

6. The assembly according to claim 5, further comprising:

a first transceiver being coupled to said electronic device; and a second transceiver being positioned within said housing, said second transceiver being electrically coupled to said second processor, said second transceiver being in electrical communication with said first transceiver.

7. The assembly according to claim 6, further comprising a signal generator, said signal generator being positioned within said housing, said signal generator being electrically coupled to said second processor such that said electronic device controls operational parameters of said signal generator via said second transceiver.

8. The assembly according to claim 7, wherein:

said hearing aid includes a speaker; and said signal generator selectively generates the white noise at a selected intensity such that said speaker emits the while noise along with the ambient sounds wherein said signal generator is configured to enhance the ear's ability to hear sounds that would otherwise be below and above a detection threshold of a human ear.

9. A hearing aid system selectively generating white noise wherein said system is configured to enhance a user's ability to hear otherwise inaudible sounds, said system comprising:

an electronic device being configured to be manipulated, said electronic device having a first transceiver;

a hearing aid being configured to be worn in an ear thereby facilitating said hearing aid to amplify ambient sounds, said hearing aid comprising:

a housing being configured to be positioned on an ear, a tube being coupled to said housing, said tube having a distal end with respect to said housing wherein said distal end is configured to be positioned in the ear, a first processor being positioned within said housing, a speaker being positioned within said housing wherein said speaker is configured to emit audible sound, said speaker being electrically coupled to said first processor, said speaker being in fluid communication with said tube wherein said tube directs the audible sound into the ear, a microphone being coupled to said housing wherein said microphone is configured to detect ambient sounds, said microphone being electrically coupled to said first processor, an amplifier being positioned within said housing, said amplifier being electrically coupled to said first processor such that said amplifier receives a signal from said microphone, said amplifier amplifying said signal such that said speaker emits the amplified signal, a button being coupled to said housing wherein said button is configured to be manipulated, said button being electrically coupled to said first processor such that said button turns said first processor on and off, a knob being rotatably coupled to said housing wherein said knob is configured to be manipulated, said knob being electrically coupled to said amplifier, said knob adjusting an intensity of said amplifier being a minimum intensity and a maximum intensity, said knob being disposed substantially at a middle of said housing on an upwardly facing surface of said housing as said housing is worn, said knob being rotatable in a plane parallel to said upwardly facing surface, said knob having a smooth peripheral surface wherein said knob is configured to inhibit abrasion of the user when said housing is worn and while said knob is rotated, and a power supply being positioned in said housing, said power supply being electrically coupled to said first processor, said power supply comprising at least one battery; and a noise generator being coupled to said hearing aid, said noise generator being in electrical communication with said electronic device such that said electronic device controls operational parameters of said noise generator, said noise generator selectively emitting white noise, said noise generator being in electrical communication with said hearing aid such that said hearing aid emits the white noise in conjunction with that ambient sounds wherein said noise generator is configured to enhance a sensitivity threshold of the ear, said noise generator comprising:

a second processor being positioned within said housing, said second processor being electrically coupled to said first processor, a second transceiver being positioned within said housing, said second transceiver being electrically coupled to said second processor, said second transceiver being in electrical communication with said first transceiver, and a signal generator, said signal generator being positioned within said housing, said signal generator being electrically coupled to said second processor such that said electronic device controls operational parameters of said signal generator via said second transceiver, said signal generator selectively generating the white noise at a selected intensity such that said speaker emits the while noise along with the ambient sounds wherein said signal generator is configured to enhance the ear's ability to hear sounds that would otherwise be below and above a detection threshold of a human ear.

* * * * *